United States Patent [19]

Ushikoshi

[11] 4,290,129

[45] Sep. 15, 1981

[54] ELECTRONIC WATCH WITH SUPPLEMENTAL FUNCTION DISPLAY

[75] Inventor: Kenichi Ushikoshi, Suwa, Japan

[73] Assignee: Kabushiki Kaisha Suwa Seikosha, Tokyo, Japan

[21] Appl. No.: 61,341

[22] Filed: Jul. 27, 1979

[30] Foreign Application Priority Data

Jul. 27, 1978 [JP] Japan ..... 53-91803
Sep. 21, 1978 [JP] Japan ..... 53-116953

[51] Int. Cl.[3] ..... G04B 9/00

[52] U.S. Cl. ..... 368/66; 368/203; 368/204

[58] Field of Search ..... 58/23 R, 23 D, 50 R, 58/85.5, 23 BA; 368/203, 204, 66

[56] References Cited

U.S. PATENT DOCUMENTS 4,058,969 11/1977 Tamaru et al. ..... 58/23 BA
4,107,915 8/1978 Sekiya et al. ..... 58/85.5 X

*Primary Examiner*—Ulysses Weldon

*Attorney, Agent, or Firm*—Blum, Kaplan, Friedman, Silberman & Beran

[57] ABSTRACT

Electronic circuits provide an indication on the face of an electronic wristwatch that battery voltage has diminished to a prescribed level and provide the same indication regardless of battery voltage by actuation of an external member. Multiple functions are activated by the same external member or members. The desired mode of operation is detected by the circuits dependent upon the position, sequence of operation and time duration in a selected position of an external member. In addition to a battery voltage operating mode, an alternative embodiment permits adjustment of minutes and hours without loss in second-hand accuracy. A counter memorizes elapsed time required for hand setting, and the second hand rapidly moves to its correct position after the hour and minute hands are set. The added function circuits are small, consume negligible power and have no adverse effect on battery life or design complexity.

23 Claims, 14 Drawing Figures

ELECTRONIC WATCH WITH SUPPLEMENTAL FUNCTION DISPLAY

BACKGROUND OF THE INVENTION

This invention relates generally to a wristwatch of the type having means to display auxiliary functions other than timekeeping functions and more particularly to a wristwatch providing an indication when battery voltage has fallen below a prescribed level. It is an important function of an electronic watch to alert users to an approaching termination of the battery life, which presents the danger that the watch will stop operation. A warning is required before the battery has insufficient capacity remaining to operate the watch. In one example of a battery-life indication device, there exists means to warn of the danger of low voltage by detecting the voltage of the battery as the battery life approaches its termination. When the voltage is low, an abnormal display is provided as compared to the display normally presented on the face of the wristwatch. The abnormal display includes, for example, advancing the second hand by an amount corresponding to two seconds at each movement and then stopping the movement of the hand for two seconds.

However, power consumption of electronic watches has been remarkably decreased so that watches can be produced having long battery life, for example, five years. Among such watches, there are watches which have an even longer battery life, in the order of seven to eight years, depending upon variations among batteries and the temperatures in which the watch is worn. As a result, though a battery-life indication device is specially provided in a wristwatch, the user may forget the abnormal characteristics of the battery-life indication mode of operation because a considerably long time has elapsed since the user has purchased the watch. The user is fearful that something is wrong with the watch when, because of low battery voltage, the second hand suddenly starts to advance by increments corresponding to two seconds.

Also, it is wasteful to incorporate single-function special circuits, e.g., a low-voltage battery-indicating circuit, because it is so infrequently put to use in the conventional prior art timepieces. Provision of auxiliary functions often raises the cost of manufacture and increases the complexity of the design. The additional functions may be, for examples, a chronograph or a facility for correction of differences in time. These functions supplement the conventional timekeeping and display functions.

In a conventional prior art watch having an analog time display with hands for hours, minutes and seconds, when an additional function is added, the visual motion of the indicating portion displaying such hours, minutes and seconds is made to perform differently from the normal movement, so that the different movement of the indicating portion serves as an identification of the additional function. For example, Japanese Patent Publication No. 49-71968, laid open under No. 13280/76, discloses that an approaching termination of battery life is indicated by having the second hand move two quick steps once every two seconds when battery voltage drops. Normally, the second hand moves uniformly every second. Further, a different state from the normal state of a watch is shown by using a light-emitting diode on the face of the wristwatch, which, for example, may indicate low battery voltage. Still further, there is a watch design in which the hand movement serves an additional function, for instance, the second hand is used both as the second hand per se and as a hand for setting the alarm time. There is also an embodiment wherein the movement of a hand serves a special function and an additional function is displayed by using another member such as a light-emitting diode.

However, a function, for example, for displaying a diminution in battery-life expectancy is operated and displayed only during the one to two weeks of a battery life extending for two to five years of normal wearing time, i.e., when the battery voltage is getting low. The electric load caused by having a special electronic circuit and a separate mechanical function for detecting this drop of battery voltage becomes large. Thus, incorporation of the function does not always justify the cost in financial terms or in battery life or design complexity.

What is needed is an electronic watch which provides for independent actuation or previewing of infrequently used functional modes of operation, and combines a plurality of functions in a few circuits and with but a minimum of external members.

SUMMARY OF THE INVENTION

Generally speaking, in accordance with the invention, an electronic watch combining a plurality of functions and distinctive means for displaying said functions is provided. Electronic circuits provide an indication on the face of the watch that battery voltage has diminished to a prescribed level and provide the same indication regardless of battery voltage by actuation of an external member. Multiple functions are activated by the same external member. The desired mode of operation is detected by the circuits dependent upon the position, sequence of operation and time duration in a selected position of an external member. In addition to a battery-voltage operating mode, an alternative embodiment permits adjustment of minutes and hours without loss in second-hand accuracy. A counter memorizes elapsed time required for hand setting, and the second hand rapidly moves to its correct position after the hour and minute hands are set. The added function circuits are small, consume negligible power and have no adverse effect on battery life or design complexity.

Accordingly, it is an object of this invention to provide an improved electronic wristwatch which includes a plurality of auxiliary functions operating from a minimum of circuits and external members.

Another object of this invention is to provide an improved electronic wristwatch which provides a low battery voltage indication, and also independently displays the low battery mode of operation regardless of battery condition upon actuation of an external member.

A further object of this invention is to provide an improved electronic wristwatch wherein the low battery voltage mode is independently indicated by using the same external member used for setting of the hands.

Still another object of this invention is to provide an improved electronic wristwatch wherein the hour and minute hands may be reset without affecting the accuracy of the second hand.

Yet another object of this invention is to provide an improved electronic wristwatch wherein the ability to preview a function is incorporated without altering the display construction.

A still further object of this invention is to provide an improved electronic wristwatch wherein the display indicates accidental operation of external members.

Another object of this invention is to provide an improved electronic wristwatch which produces a rapid movement of the second hand to the correct time position after the second hand has been stopped during minute- and hour-hand adjustment.

A further object of this invention is to provide an improved electronic wristwatch including a special function indication which is clearly distinctive without altering the display construction.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DESCRIPTION OF THE PREFERRED EMBODIMENTS

Figure 1:
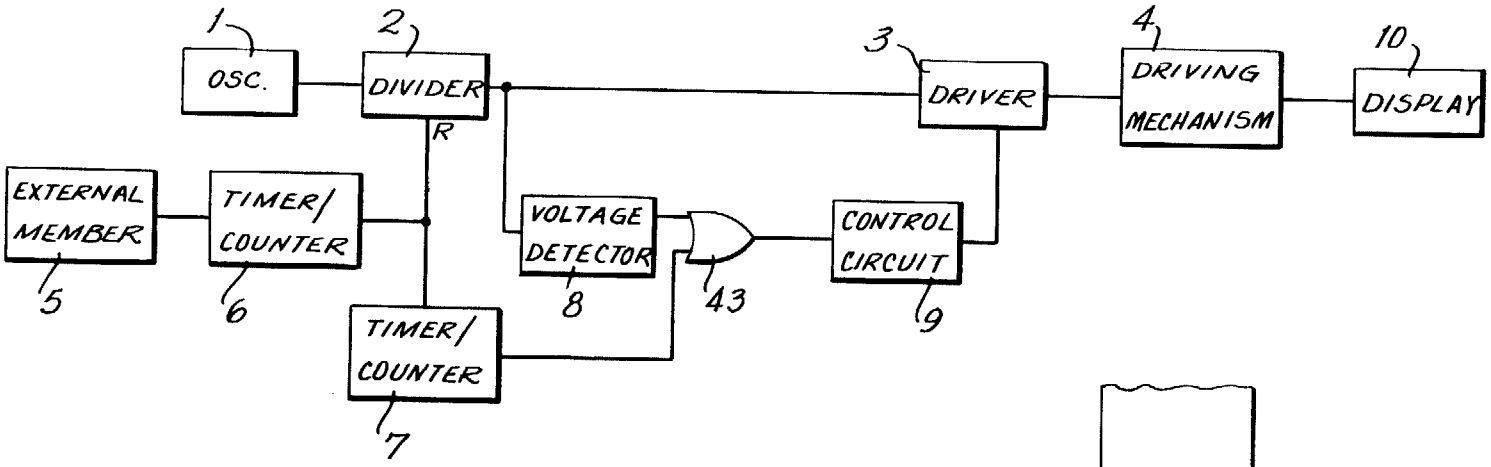
FIG. 1 is a functional block diagram of an electronic watch in accordance with this invention.

With reference to FIG. 1, a signal generated in an oscillator 1, having a time standard such as a quartz crystal vibrator, is divided by a divider circuit 2 which is constructed as an integrated circuit. The divider output signal is changed in a driving circuit 3 to a wave form suitable for inputting to a coil of a motor to rotate the motor in a driving mechanism 4 including a gear train, so that the time, that is, hour, minute and second, is indicated by a time display 10. In this embodiment, the driving means 4 and the display means 10 are considered to be those of an analog quartz crystal watch; however, it is also possible to apply this invention in a digital display quartz watch. Usually, in an analog quartz crystal watch with a second hand, the second hand is rotated once a second by an angular increment corresponding to one second. A state of reduced voltage is indicated by advancing the second hand twice in succession in motions lasting 1/10 second or less, and similarly advancing the second hand twice in succession again after approximately two seconds has elapsed. For that purpose, circuit means 8 for detecting a reduction in the battery voltage is provided, and there is a circuit network for inputting signals to the driving circuit 3 of the motor in the driving mechanism 4 through the control circuit 9. Further, in this invention, a timer or a counter 6 is started and stopped by operating an external member 5. As a result, when the input actuation time of the external member 5 is shorter than a selected built-in time for the timer 6, the dividing circuit 2 is not reset but continues to divide down the output of the oscillator 1. Further, an output is obtained from the timer 6 by which a following timer or a counter 7 is operated. Continuously, the battery-life control circuit 9 operates to sense battery-voltage level.

Figure 2:
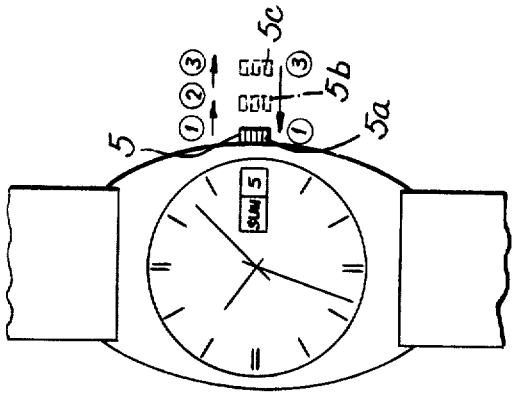
FIG. 2 is a face view of an electronic watch of this invention showing positions of the crown.

The timer 6 resets the divider circuit 2 if signals are input from the external member 5 for a longer time period than the selected built-in time of the timer 6. Such a longer time occurs in a normal hand adjustment of the watch hand positions. This condition is explained herein with reference to the operation by pulling and pushing a crown 5 (FIG. 2) of the watch. The crown 5 corresponds to the external member 5 in FIG. 1. The second hand of the wristwatch advances exactly by one second increments per second when the crown or winding stem 5 is placed at the first position 5*a*, since this position is neutral. At position 1, operation of the winding stem 5*a* has no relation to the watch operation. Date and day displays as seen in FIG. 2 are corrected by rotating the winding stem 5 when the winding stem is placed at the second position 5*b*. When the winding stem is pulled out to the third position 5*c*, a second-hand setting lever, namely, a reset lever not shown in the Figures, which is interlocked with the winding stem 5, operates so that the second hand is fixedly positioned while the divider circuit is held in a reset condition. The hour and minute hands are adjusted when the watch is in this mode of reset and fixed second hand. The second hand starts, generally in synchronism with an external time signal, by pushing the winding stem 5 from the third step position to the first step position after adjustment of the hour and minute hands. The resumption of normal timekeeping can thus by synchronized to an external time signal, for example, received by telephone.

For the purpose of maintaining simplicity in the mechanical design, the crown 5 is used in its third position 5*c* for another function, as explained hereinafter. Operation of the external member 5 within a short period of time is distinguished by the electronic circuits from a usual hand adjustment using the same external member. Pulling of the winding stem 5 from the first or second position to the third step position and then in an extremely short time, such as a single second, pushing the stem from the third step position to the first step position initiates a different function. By execution of the rapid pull push of the stem 5, a circuit is controlled to make the second hand advance in the same abnormal manner produced by the battery-life indication circuits 8 when the source voltage is low. This abnormal motion of the second hand is produced even though the battery voltage is normal.

In summarizing, if the time for resetting the circuit is long and, for example, more than ten seconds elapse while the crown 5 is in the third step position, such as in adjusting the hour and minute hands as described above, the second hand starts from a fixed position just one second after the winding stem 5 is pushed from the third position to the first position. This is a conventional resetting mode of operation. The same abnormal hand movement as in a low-voltage battery condition is displayed on the face of the wristwatch of this invention by a rapid operation of the external member 5. This abnormal hand movement is displayed even if the battery voltage is normal.

Figure 3:
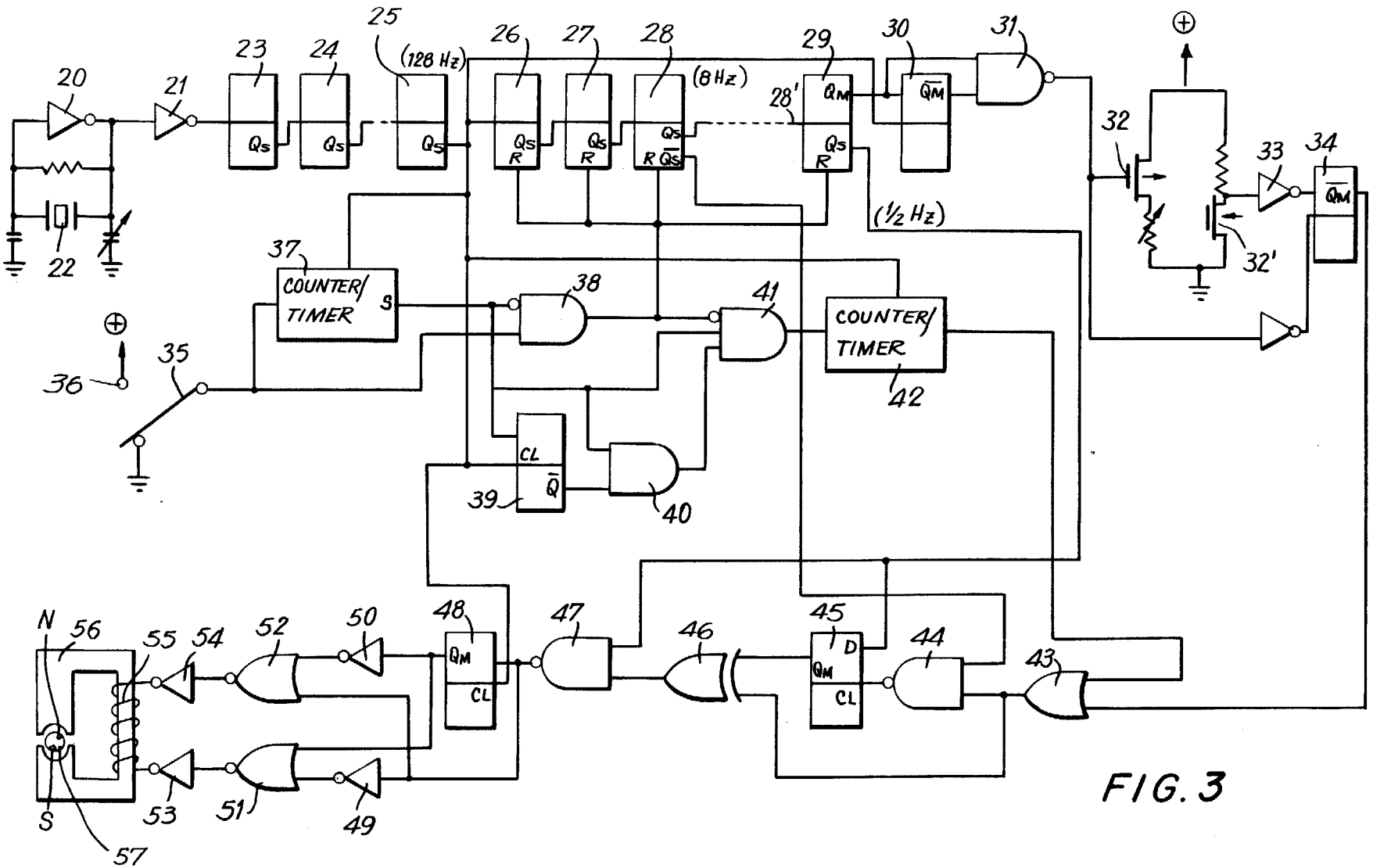
FIG. 3 is a circuit for the electronic watch of FIG. 1.
Figure 4:
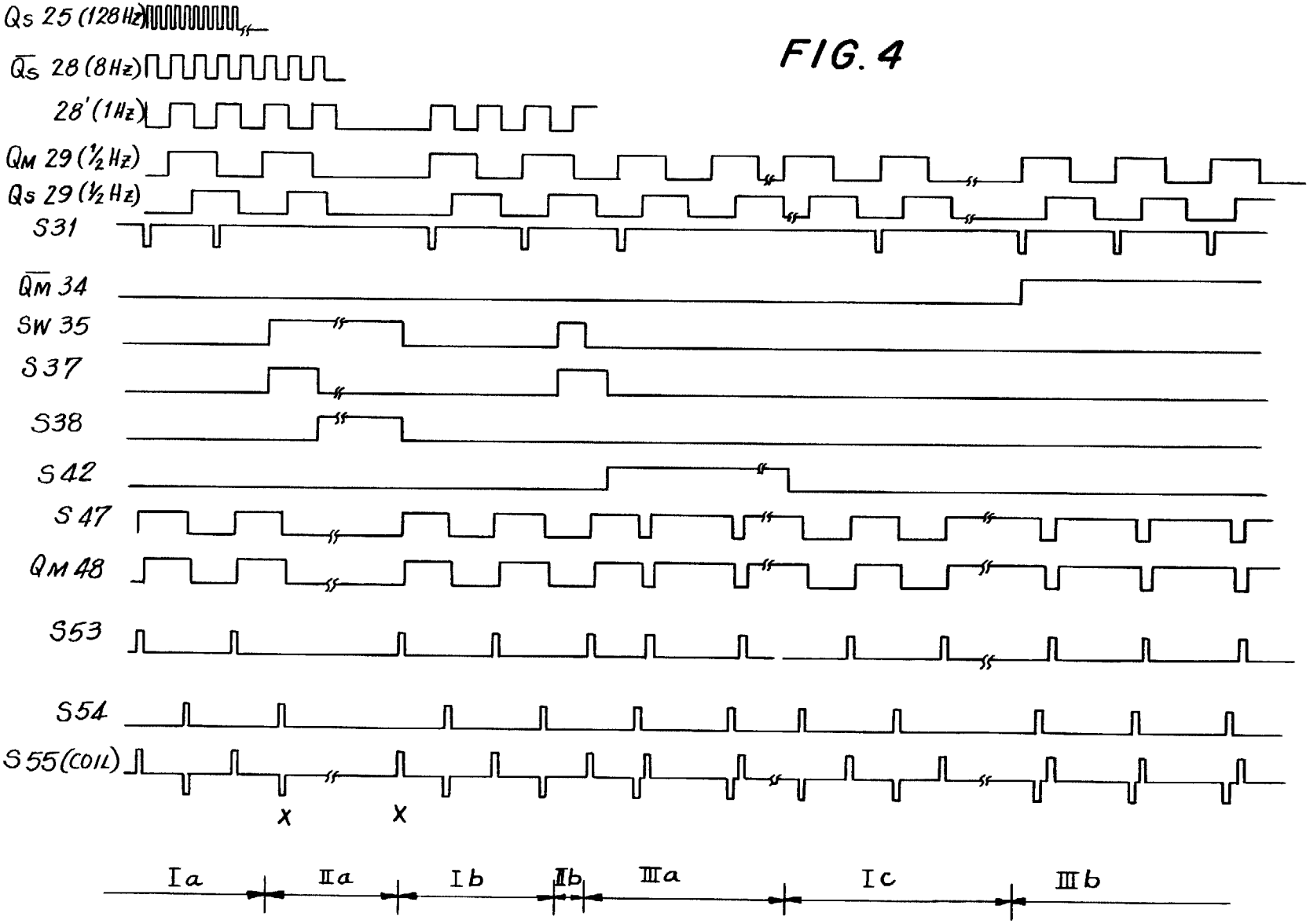
FIG. 4 is a timing chart showing wave forms associated with the circuit of FIG. 3.

A more detailed description of this invention follows. With reference to FIGS. 3 and 4, the time-standard vibration signal output of a quartz crystal oscillator circuit is divided by a circuit including flip-flop stages 23–29. For example, the 32 kilohertz vibration of the quartz crystal vibrator 22 is divided down to ½ Hz. The MOS integrated-circuit transistor 32 operates as a voltage-detecting sensor for turning the integrated-circuit transistor 32' on or off in response to the level of the supply voltage. That is, an output $Q_M$ of flip-flop 34 is low if the voltage is normal, and the output $Q_M$ is high if the battery voltage is reduced below a predetermined level. When the winding stem is pulled out to the third step, a lever 35, which is interlocked with the winding stem, mechanically controls a gear train (not shown) or a motor to allow adjustment of the minute and hour hands. At the same time, the lever 35 electrically connects with a pin 36 connected to the positive source (high) of voltage. Thereby, a high signal is input to a timer or a counter 37, which outputs a high for a predetermined time, for example, one second. When the high signal is input by means of the lever 35 to the counter 37 for more than one second, a gate 38 responds to the output of the timer 37 and a high output is generated after one second when the counter 37 goes low. The high output of the gate 38 resets flip-flops 26–29 of the divider circuit. The second hand is motionless while those divider stages are in a reset condition. The second hand starts moving again exactly one second after the reset signal is released. Removal of the reset signal occurs when the winding stem is pushed from the third step position to the first step position and the lever 35 is at ground potential (low). For example, the stem is pushed in in synchronization with an external time signal after the minute and hour hands have been correctly adjusted.

In a circuit for driving the motor, a ½ Hz signal passed through a NAND gate 47 is input to a coil 55 as an inverted signal of, for instance, 7.8 milliseconds by a flip-flop 48, inverters 49, 50, 53, 54 and NOR gates 51, 52, so that the motor, which consists of a stator 56 and a rotor 57, is rotated once a second.

It will now be assumed that the movement of the control lever 35 is interlocked with the winding stem of the watch, and the external winding stem and the lever are pulled to the third position and then pushed to the first position within one second. The output state of the counter 37 after one second is produced in a flip-flop 39 and a gate 40 as a result of the action of the winding stem 5. The output signal from gate 38 remains low and the divider is not reset when the switch 35 is actuated over a period less than a second. Therefore, an AND gate 41 operates when the switch 35 is actuated in a short period, less than a second. The output of the AND gate 41 generates a high output in a counter or timer 42, which lasts, for example, for 10 seconds.

When either a high output $Q_M$ from flip-flop 34 or a high output from the counter 42 is input to gate 43, the control signal is passed through the gate 43. This signal causes an output $Q_M$ from flip-flop 45 with a delay of half the period of an 8 Hz signal, namely, 64 milliseconds, because of a NAND gate 44 and the D-type flip-flop 45. As previously stated, signals pass through the gate 43 when the output $Q_M$ of flip-flop 34 is high, which occurs when the battery voltage is reduced, or when the output of the counter 42 is high. This occurs when the switch 35, actuated by the external stem, is moved between its extreme positions in less than one second. Enabled by a high output from gate 43, the NAND gate 44 passes the frequency signal generated in the divider flip-flop 28. As a result, movement of the second hand differs from that in a normal operating mode; for example, the hand moves twice in succession and stops for the remainder of a two-second interval. This wave form.S55 is shown in FIG. 4 in periods identified as IIIa and IIIb. This mode of operation differs from the normal mode shown in periods Ia, Ib, and Ic.

The wave forms at the coil 55 which control the motion of the rotor 57 and their relationship to the operation of the external winding stem are explained more fully hereinafter with reference to the timing chart shown in FIG. 4. Zone Ia is a period during which the second hand advances normally by one step per second. Zone IIa is a period during which the winding stem is at the third step position and the hour and minute hands are adjusted during a period which extends more than one second. And the divider circuit is continuously reset, so that no output is generated to the rotor 57. During the period Ib, the second hand starts correctly one second after the reset is released by return of the stem to step position 1. During the period identified as IIb, the winding stem is pulled out to the third step and then is pushed back to the first step position within one second of elapsed time. The divider circuit is not reset in this condition; that is, the output of gate 38 remains low. During the period identified as IIIa, although the battery voltage is at a normal level, the second hand moves in the same abnormal manner as under the condition when the battery voltage is reduced below a prescribed level. During the period identified as Ic, the second hand moves normally by one step per second again, since the watch automatically returns to the normal condition after a predetermined time has elapsed, such as 10 seconds, as determined by the timer counter 42. The zone identified by IIIb is a period wherein the second hand moves differently from the normal mode of motion because the battery-voltage-detecting circuit detects a reduction of the battery voltage below a prescribed level and the output $Q_M$ of flip-flop 34 is high.

While the movements of the second hand are described above, a reduction of the battery voltage can also be clearly indicated by a similar apparatus in a watch which has only an hour and a minute hand. The voltage indication is provided in such an embodiment by moving the minute hand differently from its normal mode of motion. Also, battery life may be indicated by a similar method in a watch having a digital display.

Figure 5:
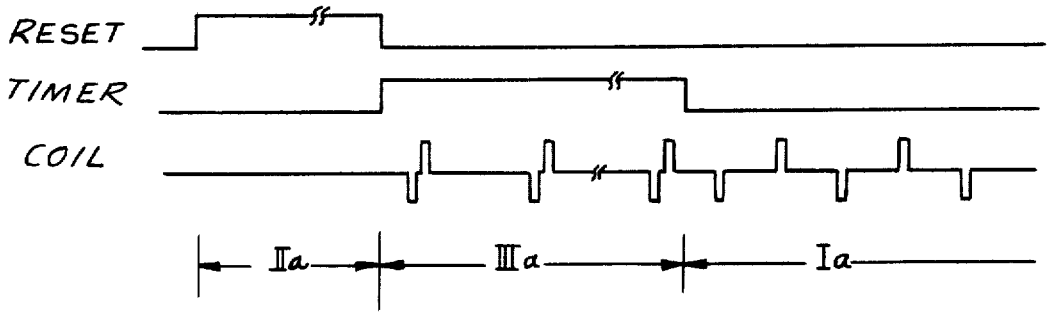
FIG. 5 is a timing chart associated with an alternative embodiment of the electronic watch of this invention.

FIG. 5 shows wave forms for an alternative embodiment for producing the same abnormal effect in the motion of the second hand as described above. According to the signals shown in FIG. 5, the winding stem, when pulled out to the third position, always resets the divider circuit. Then the hour and minute hands are set by turning the stem. After the winding stem is pushed from the third step position to the first step position, the attention of the user is attracted by the second hand operating in the same manner as that mode which occurs when the battery-life-indicating circuit is activated by an actual low-voltage condition. In FIG. 5, the zone identified as IIIa shows the abnormal signals on the motor coil, which are not so uniformly spaced as the normal signals indicated by the zone Ia. The duration of the abnormal signals is controlled by a timer which measures time from the moment that the winding stem is pushed from the third step position to the first step position.

Figure 6A:
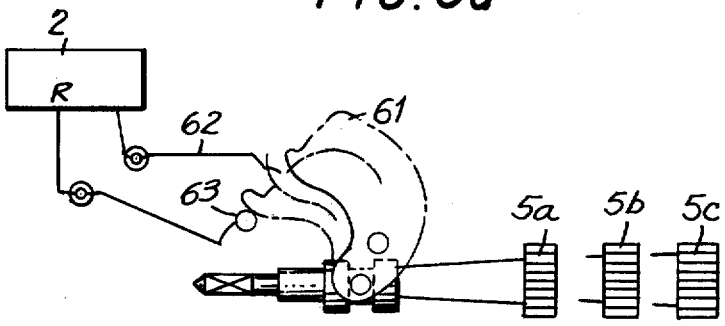
FIG. 6*a* shows the electromechanical interconnection between the crown and the circuits of the electronic watch of this invention.
Figure 6B:
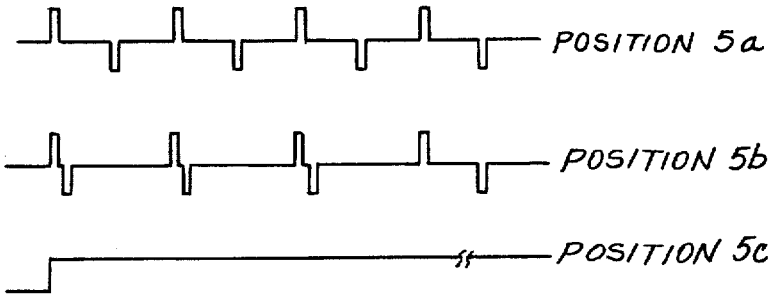
FIG. 6*b* is a timing chart showing wave forms associated with the operation of the device of FIG. 6*a;*

FIGS. 6*a* and 6*b* show wave forms for another alternative embodiment of the watch of this invention. The movement of the second hand differs in accordance with the position of the winding stem 5, which can take on three positions, namely, the first position 5*a*, the second position 5*b*, and the third position 5*c*. The second hand moves normally when the winding stem is at the first position, as illustrated in FIG. 6*b*. When the winding stem is at the second position, a setting lever 61, which is interconnected with the winding stem 5, is in the second position and touches a spring 62 which is connected to the electronic circuits. A signal is sent to the divider circuit 2 when the stem is in the second position so that the second hand moves in the same manner as it does in the battery-life-indicating mode. When the winding stem is in the third position, the divider circuit 2 is reset and the gear train motion is arrested. Adjustment of the hour, minute and second hands can be performed with the motor in an undriven state. The movement of the second hand in this embodiment indicates whether or not the winding stem is in its normal position, that is, step position 1, because the second hand moves abnormally if the winding stem is pulled out carelessly or unintentionally when the watch is worn.

In prior art watches, in order to see the battery-life-indicating mode of operation, it has been required that the battery be changed for another battery which actually has a low voltage, or the circuit of the watch is operated by an externally applied source of voltage. The watch of this invention provides a function by which the battery-life-indicating mode can be shown when battery voltage is normal merely by adding elements to the integrated watch circuits without changing the remaining conventional structure of the watch. This special feature can be provided very easily without the need for adding an additional button on the watchcase by using the existing stem or crown. Also, a salesman can easily show a potential purchaser in his shop how the watch displays the low-voltage battery condition. In this way, the salesman can win the potential buyer's confidence. The user's anxiety about the termination of the battery life is reduced because the user can easily know at any time what is the movement in the battery-life-indicating mode. It is especially difficult in watches with only an hour and a minute hand to make a hand move abnormally. It is much easier to work with a watch having a second hand. For example, the minute hand can be vibrated or advanced a little faster in order to alert the user to the impending termination of the battery life. In such instances, the user can correctly evaluate the condition of his watch according to this invention, since the user knows in advance how the watch moves when the battery voltage is diminished. Thus the watch of this invention provides a great benefit to the user.

Figure 7A:
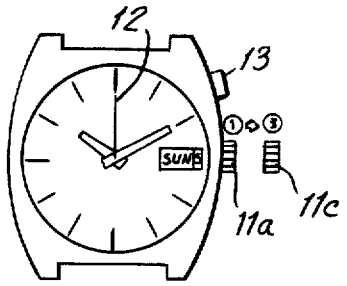
FIG. 7a PRIOR ART
FIGS. 7*a–e* show the face of an alternative embodiment of the electronic watch of this invention and indicate the effect of operation of external members.
Figure 7B:
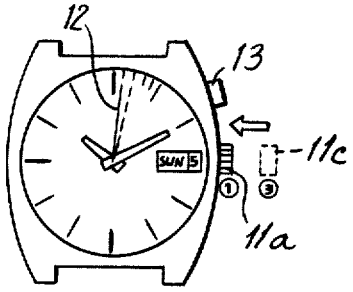
FIG. 7b PRIOR ART

The alternative embodments of the watch of this invention described below include an external button as well as the crown or stem. FIGS. 7*a* and 7*b* show the functions of reset and regulation which are used in a conventional quartz crystal wristwatch having an oscillator with a quartz crystal vibrator so as to obtain an accurate time setting. When the watch is to be set by using an external synchronizing signal, such as a telephone signal or a siren sounding, the crown 11 is pulled out from the neutral first position to the third position at the moment when the second hand 12 arrives at the position of 12 o'clock on the face of the dial. A lever (not shown) which is mechanically interlocked with an external operating member such as the crown 11 regulates a part of the internal gear train (not shown) and also causes the electronic circuit to be reset, so there is no automatic hand motion.

At the third position, the crown 11 is then rotated so as to correctly set the hour and minute hands on the face of the wristwatch. Pushing the crown 11, as shown in FIG. 7*b*, into the first position on the sounding of an external synchronizing time signal causes the regulation of the gear train and the reset of the electronic circuit to be released. Then, the second hand 12 correctly starts to move away from the 12 o'clock setting at a normal rate of one-second increment per second. The hand setting is thus completed.

Figure 7C:
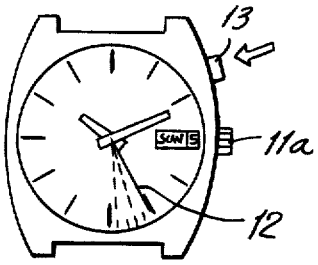
Figure 7D:
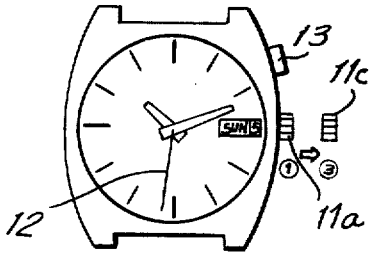

In the wristwatch of this invention, to the above-mentioned time-setting function is added a function by which the hours and the minutes can be corrected without putting the second hand out of order. An external synchronizing signal is no longer needed in using this alternative mode of operation. In FIG. 7*c*, a signal is input into the electronic circuitry by pushing a button 13 on the watchcase, which causes the second hand 12 to move in a different manner from the normal motion. For instance, the second hand 12 may be stepped once in two seconds (FIG. 7*c*) so that the movement of the second hand is made the same as that movement at the time of a battery voltage drop as described above. Alternatively, the second hand may be stepped once in ten seconds. Or, other different movements may be useful, for instance, movement of three times over a one-second face interval. While the second hand moves in any of the above-mentioned abnormal modes, a part of the gear train, or the motor, is regulated by pulling out the crown 11 to its third position as shown in FIG. 7*d*. Then the second hand stops. It should be noted that although the second hand moves erratically as compared to its normal motion, it remains accurate. That is, if it advances every two seconds, it will move every two seconds through an angular arc on the dial equaling two seconds, as marked.

Figure 7E:
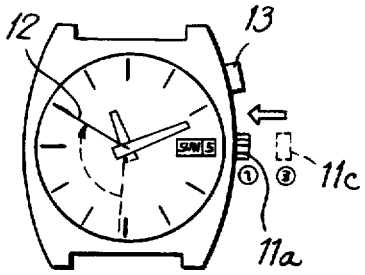

After the button 13 has been pushed, the electronic circuitry is not reset when the crown 11 is pulled to the third position as in the instance of the conventional watch described above, which uses a synchronizing signal. In this embodiment, the crown 11 is operated while the second hand is rotating with a different movement from normal after the button 13 has been pushed. Then the second hand 12 stops (FIG. 7*d*). The duration of the time period during which the crown 11 is in the third position is stored in a memory using signals from the timekeeping circuit, which is not reset. The positions of the minute and hour hands are set while the crown 11 is in the third position by rotating the crown. When the crown 11 is returned to the first position after the minute and hour hands are set, the second hand 12 rapidly moves to its correct location on the dial. FIG. 7*e* shows the state of the watch immediately after the crown is pushed to the first position from the third position to complete the procedure.

For an example, assume that an accurately operating watch is to be put forward by an hour in order to correct for a difference in time when traveling across time zones. Also assume that it takes about 15 seconds to perform such a time-difference correction. In this example, the second hand is quickly advanced by the time period during which the crown 11 was positioned in its third position. As a result, the time period taken to perform the correction of the difference in time at the third position of the crown 11 is compensated. Thus, it is possible to correct the time difference without putting the second hand out of order. It is brought rapidly to the position where it would have been without a time-difference correction, and a precisely accurate timepiece retains this condition after the time correction without manual operation related specifically to the second hand.

In FIG. 7*c* is illustrated an embodiment that uses another external button 13. Some other devices and procedures are also possible to accomplish the same function. For example, in order to apply the signal to the electronic circuit in such a manner that the second hand makes unusual movements, the crown 11 may be further pushed inward, rather than pulled outward, from the first position, or the signal may be applied to the electronic circuitry only when the crown 11 is positioned in the third position twice rapidly in a given time period. Such procedures are possible in view of the electronic circuitry and the design of the mechanism. Also, it should be understood that the same type of action can be applied to the minute hand in watches which have no second hand.

Figure 8:
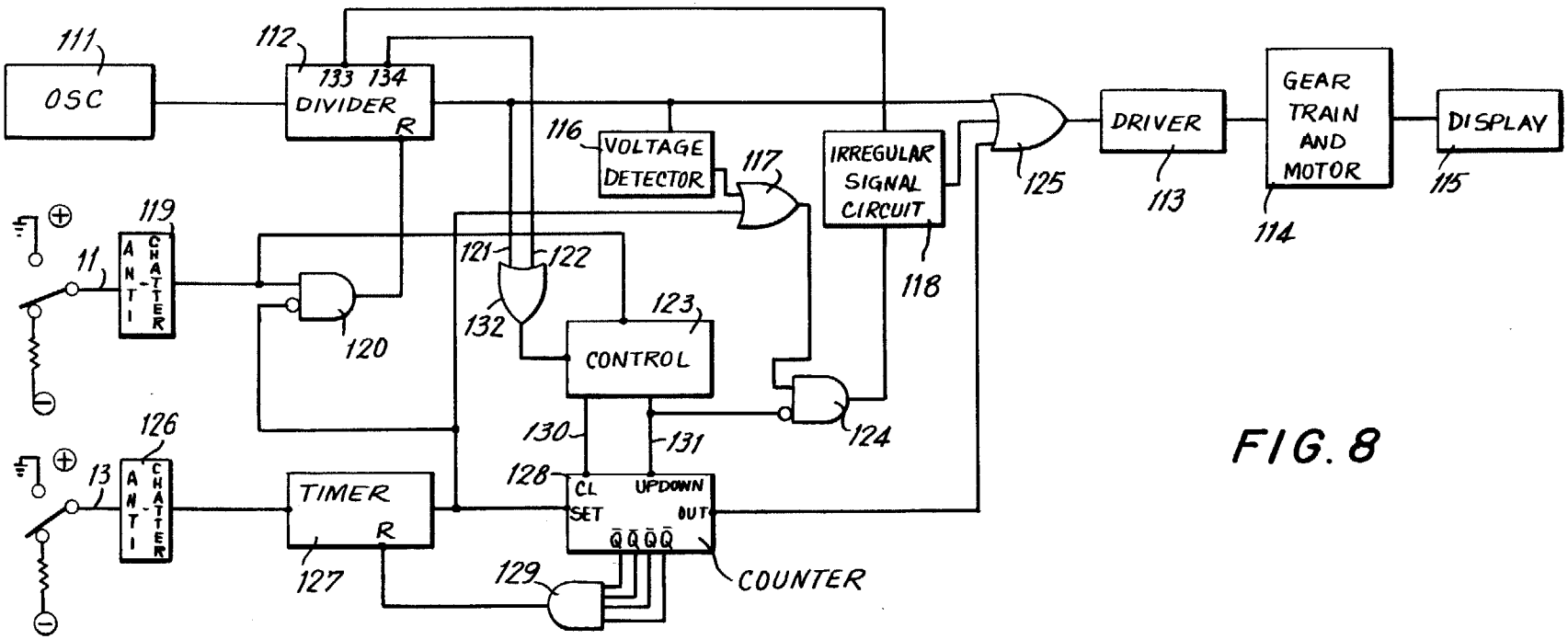
FIG. 8 is an electronic circuit used in the alternative embodiment of FIG. 7.
Figure 9:
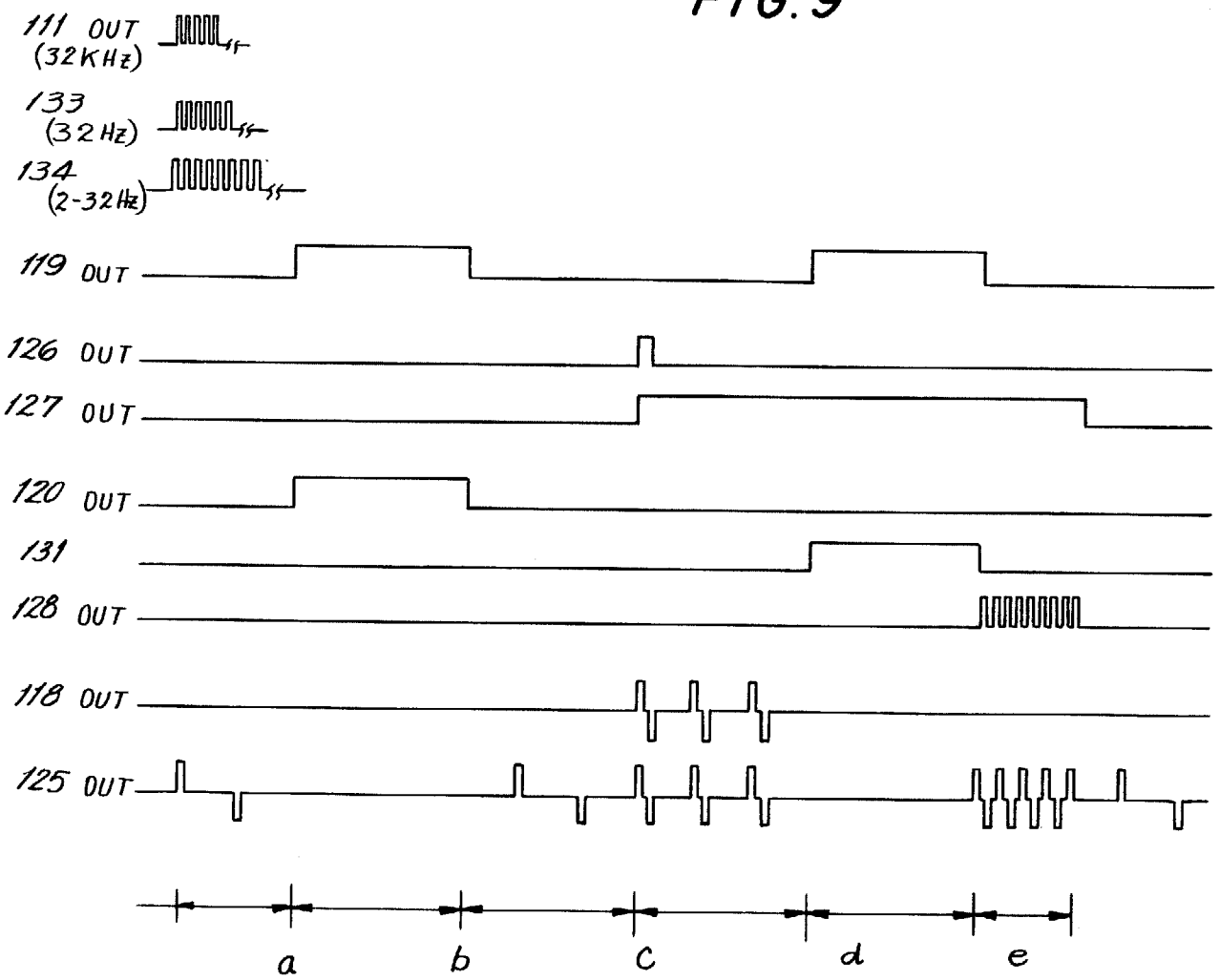
FIG. 9 shows wave forms associated with the circuit of FIG. 8.

FIGS. 8 and 9 show an actual exemplary circuit and the associated wave forms. In FIG. 8, an oscillator circuit 111 outputs a time-standard signal such as provided by a quartz crystal vibrator or the like. A divider circuit 112 including flip-flop stages formed in an integrated circuit, or the like, receives the time-standard signal. A driving circuit 113 receives the divider output and actuates a gear train and a motor 114, which in turn operates the indicating display 115 of hours, minutes, seconds, etc. A switch 11 is mechanically interlocked with the crown, and a second switch 13 operates through an external button. Circuits 119, 126 prevent chattering of the switches 11, 13 respectively. The circuit is further comprised of a counter-controlling circuit 123, an up-down counter 128, a battery-voltage-detecting circuit 116, a circuit 118 for applying irregular signals, and gates 117, 120, 124, 125, 129 and 132.

Operation of the circuit is described hereinafter. Normally, every second a signal is input to the driving circuit 113 through the divider circuit 112 as an output signal, and the second hand in the display 115 is operated. In a procedure of time correction, the switch 11, which is mechanically interlocked with the external crown, is operated to reset the divider circuit 112. Then, the watch hour and minute hands are reset when the crown is in its third position, and the watch is released from the reset state when the crown is returned to its first position. After being released from the reset state, the second hand starts to move accurately.

The switch signal circuit 127, which is usually in a low state, goes to a high state by pushing the switch 13. Switch 13 is mechanically interlocked with an external button. The signal out of the circuit 116 for detecting a drop in the battery voltage below a prescribed level is usually in a low state when the battery voltage is normal. This becomes a high state at the time when the battery voltage drops.

At the time of normal hand movement, the output pulse from the gate 125 to the driver 113 is inverted every second (FIG. 9). However, when either the output of the switch signal circuit 127 or the signal out of the voltage-detecting circuit 116 becomes a high state, an irregular wave-form-outputting circuit 118 applies a signal to the driver 113 having an inverted pulse during 15.6 milliseconds every two seconds. The second hand in the indicating display 115 is stepped by two one-second increments occurring substantially without delay between incremental movements, once every two seconds. Thus, when the battery voltage drops because of impending termination of battery life, or when the switch 113 is operated, the user is alerted because the second hand makes unusual movements.

In the above description, it is stated that the same movement of the second hand shows both that the battery voltage has dropped and that the switch 13 is operating. However, of course, these states may be shown by different movements, for example, of the minute hand.

When hand setting begins after pushing the switch 13 with the crown being placed in the third position to operate the switch 11, signals are applied from the counter-controlling circuit 123 to the lead 131. These signals cause the up-down counter 128 to start up or down operations at times of starting and finishing, respectively, the operation of the switch 11. The up-down counter 128 starts an up operation or a down operation according to the condition of the controlling circuit 123. The up-down counter 128 counts up when the normal time signal 121 is applied as a clock signal during the up operation. The up-down counter 128 counts down when the quick-advance signal 122 is applied as a clock signal during the down counting operation. During a down counting operation, the quick-advance signal is continuously outputted to the driving circuit 113 until the content of the up-down counter 128 becomes zero. The switch signal circuit 127 is adapted to reset to low when the content of the up-down counter 128 becomes zero. However, in a situation where the crown switch 11 is not operated even though the button switch 13 is pushed, by using a timer of one to five minutes as a switch signal circuit 127, the second hand is differentiated in its movement from normal only during the time when the timer is operated. By this method, the user can be aware that the watch is in a special mode of operation for a fixed time.

FIG. 9 is a timing chart associated with the circuit of FIG. 8. Corresponding states a–e of the watch are shown at the bottom of FIG. 9 and in FIGS. 7*a–e*. Abnormal step movement of the second hand during the period starting at (c) gives the user clear notice that a time-difference correction is possible.

In another embodiment of this invention, the second hand is regulated by a unit of ten seconds. The second hand is stepped once in two seconds by operating the external operation member. During the time when the watch is in such a previewing state, the crown is pushed with the second hand at a ten-second marking like the zero-second position, the tenth second, the twentieth second, etc. Then the position of the second hand is memorized through the electronic circuit, and a 1/10 counter is started, so that the position of the second hand and the contents of the counter correspond with each other. When the user wears the watch in such a state and pushes the crown to set the time, the second hand is quickly advanced to the position at which the content of the counter is ten. That is to say, the second hand is made to stop at the position of the marking of ten seconds, and the crown is pulled at that time. Then, by pushing the crown in to set the watch by a synchronizing time signal, the second hand accurately starts. Thus, the ten-second positioning of the second hand at ten-second increments can be obtained. Previously, the ten-second positioning of the second hand was done mechanically by utilizing a heart-shaped cam. However, according to this invention, it is easily achieved electronically.

Yet another embodiment, an alarm-setting mechanism, can be provided. In an electronic watch with a buzzer, while the second hand is stepped every two seconds after the external button is pushed, if the button is pushed again when the second hand comes on a tenth-second position, the buzzer will sound after ten minutes, for instance, or at 2 o'clock, because the tenth-second position of the second hand is identical with the 2 o'clock position of the hour hand.

In a further embodiment, it is possible that the second hand be quickly advanced by five-second increments if the button is pushed during the time when the second hand is stepped once in two seconds by two-second increments. This mechanism can also be used as an indicator.

This invention is applicable to the minute hand of a watch having only the hour and minute hands. All the embodiments described above are watches having hands. However, as previously indicated, this invention also can be applied to a digital watch with a liquid crystal display. The following advantages can be obtained by using the movement of the indicator portion of a watch as a previewing means for showing that the watch is in a ready state for performing another function in the future.

The structure is simple. As shown in the examples above, electronic circuitry is used, and accordingly, a construction depending upon only hand movement is simpler than that of a watch wherein the dial is provided with a light-emitting diode, or wherein the dial is provided with an opening from which a mark is shown when it becomes time for previewing a function such as low battery voltage. The cost is not raised by modifying the electronic circuitry and not the mechanical structure.

If a light-emitting diode or other special indicating member is used on the dial, the dial is limited in design. Furthermore, in such a case, indicator movement for a watch which has a function for previewing the state for another function should be distinguished from an indicator movement not having such a previewing function. With a light-emitting diode, there are disadvantages to the productivity and to the service of the watch after sale. On the other hand, as the design of the dial is not limited by the structure according to this invention, this invention can be applied to any watch, such as high-grade watches or dress watches. Furthermore, regarding service after sale, it is very easy to service a wristwatch according to this invention because only an independent circuit block need be replaced.

Use of a light-emitting diode largely increases the current consumption from the battery. As a result, the quality and performance of the watch are reduced. However, according to this invention, even if the previewing function for showing another state is provided, over-all performance of the watch is not lowered.

The display according to this invention is easy to understand. The second hand makes a different movement from the norm by operating the external switch, and such a different movement is continued. Accordingly, the user can easily know that the watch is in the previewing state for another function.

The user can surely confirm the state of changing performance into the following function. As the user begins the operation of a following function, for example, operation under low battery voltage conditions, he can confirm the different movement of the second hand by the procedures described above. Then the user can use the watch with a sense of assurance, since he knows the operating mode. This fact is very important because it is necessary for a multifunctional watch to be easy and reliable to use.

If the external button is pushed, the watch comes into the previewing state for another function. When the watch is released from the previewing state after a fixed time has elapsed, the indicating hand makes the normal movements. Then, the user knows that the previewing state has been released. That is, should the user push the button by accident, the previewing state is released even if the crown is not operated during the time when the watch is in the previewing state.

Compared to a watch wherein another function is suddenly provided by pushing a button, the watch according to this invention has advantages. That is, when an infrequently used function, such as the correction of a difference in time, is used, the user can correct the time difference with a sense of assurance because the watch is provided with the function for giving him information that he may correct the time difference. This function is valuable for quartz watches of high accuracy and high reliability.

It should be understood that in all embodiments the crown or stem can be used in the second position to perform additional functions such as adjustment of the indicated day and date.

It will thus be seen that the objects set forth above, and those made apparent from the preceding description, are efficiently attained, and since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic watch including a time-standard frequency-signal-generating means; a divider network dividing down said standard frequency signal and outputting a timekeeping signal of lower frequency; display means for indicating timekeeping functions; driving means, said driving means receiving said timekeeping output of said divider network and outputting signals to actuate said display means; an electrical power source for energizing the elements of said watch including said signal-generating means, said divider network, said display and driving means; the improvement therein comprising:

control means, said control means when enabled being adapted to pass a supplemental signal to said driving means said supplemental signal being outputted from said divider network;

detecting circuit means responsive to the voltage level of said power source, said detecting circuit means enabling said control means to pass said supplemental signal and causing said display means to output abnormal indications of said timekeeping functions when said source voltage drops below a prescribed level;

selectively actuatable preview circuit means, said preview circuit means being adapted to enable said control means and cause said abnormal indications of said timekeeping functions to occur in response to the actuation thereof when said source voltage exceeds said prescribed level.

2. The electronic watch as claimed in claim 1 and further comprising an external member, said preview circuit means being actuated by operation of said external member.

3. The electronic watch as claimed in claim 1, wherein said watch is an analog watch and said abnormal indications occur in the motion of a hand.

4. The electronic watch as claimed in claim 3, wherein said hand is the second hand and said abnormal motion includes periodically two rapid one-second motions followed by a stationary pause in each elapsed two-second time interval.

5. The electronic watch as claimed in claim 2 or 4, wherein said watch is adapted to operate normally when said external member is in a first position, said divider network is adapted to be reset and said display means to remain unchanged when said external member is moved to a second position and maintained therein beyond a first predetermined time period.

6. The electronic watch as claimed in claim 5, wherein said display means is adapted to indicate said abnormal motions when said external member is displaced from said first position to said second position and then returned to said first position in less than said first predetermined time period, said abnormal motions being caused by said external member actuating said preview circuit means.

7. The electronic watch as claimed in claim 6 and further comprising timer means, whereby said abnormal indications are terminated by said preview circuit means after a second predetermined time period has elapsed.

8. The electronic watch as claimed in claim 5, wherein said display indications are adjustable while said divider network is reset.

9. The electronic watch as claimed in claim 8, wherein said external member is connected for manually performing an adjustment of said displayed timekeeping functions while said divider network is reset.

10. The electronic watch as claimed in claim 9, wherein said external member is a crown, said crown normally being in said first position and being pulled out to said second position and rotated to adjust said displayed timekeeping functions.

11. The electronic watch as claimed in claim 1 and further comprising a first external member, a second external member and means for adjusting said timekeeping functions indicated by said display means.

12. The electronic watch as claimed in claim 11, wherein said adjusting means include said second external member, and said preview means are actuated by operation of said first external member.

13. The electronic watch as claimed in claim 12, wherein said means for adjustment includes memory means, said memory means being activated by the combined consecutive actuations of said first external member and the movement of said second external member to said second position from said first position, said memory storing data indicative of the elapsed time when said second external member is in said second position, said actuation of said first external member causing said abnormal indications to be displayed.

14. The electronic watch as claimed in claim 13, wherein said stored data is derived from said divider network.

15. The electronic watch as claimed in claim 13, wherein said second external member is connected, when moved from said first to said second position, to permit manual adjustment of said indicated timekeeping functions, said second member, when in said second position, prevents automatic changes in said indicated functions, whereby said display no longer indicates correct instantaneous time.

16. The electronic watch as claimed in claim 15 and further comprising means for driving said display functions at an accelerated pace, said accelerated driving means being activated after said combined actuations and after said second external member is returned to said first position, said accelerated driving means being adapted, in response to said stored data, to cease said accelerated output when said display indicates correct instantaneous time, whereby said elapsed time is compensated.

17. The electronic watch as claimed in claim 16, wherein said watch is an analog watch and said abnormal indications and said accelerated pace occur in the motion of the second hand.

18. The electronic watch as claimed in claim 17, wherein said second hand is unmoved when the minute and hour hands are manually adjusted.

19. The electronic watch as claimed in claim 18, wherein said memory means include an up-down counter, said up-down counter counting up to record said elapsed time and counting down to zero to indicate the completion of the accelerated return of said second hand to the correct instantaneous time position after said second external member is returned to said first position.

20. In an electronic watch including a time standard frequency signal generating means; a divider network dividing down said standard frequency signal and outputting a timekeeping signal of lower frequency; display means for indicating timekeeping functions and a plurality of supplemental functions; driving means, said driving means receiving said timekeeping output of said divider network and outputting signals to actuate said display means in a timekeeping display mode; the improvement therein comprising:

control means, when actuated, for passing a supplemental frequency from the divider network to said driving means for causing a display mode differing from a normal timekeeping display mode, said control means being actuated alternatively by a preferred signal which represents a second of said plurality of supplemental functions and by a manual actuated external member which generates a signal to represent a first of said plurality of supplemental functions, a second supplemental function means for automatically generating said preferred signal, whereby the said display mode differing from said normal timekeeping display mode serves two separate and independent supplemental functions, said second function previewing said first function.

21. The electronic watch as claimed in claim 20, wherein said first supplemental function is low-battery-voltage-level detection, said level detection mode being automatically initiated.

22. The electronic watch as claimed in claim 20, further including circuit means whereby errors introduced in said timekeeping display by the performance of said second supplemental function are automatically compensated.

23. The electronic watch as claimed in claim 20, wherein said first supplemental function is automatically initiated upon the occurrence of a predetermined condition.

* * * * *